US009952004B2

(12) United States Patent
Wright et al.

(10) Patent No.: US 9,952,004 B2
(45) Date of Patent: Apr. 24, 2018

(54) HIGH EFFICIENCY THERMAL TRANSFER PLATE

(71) Applicant: Solid State Cooling Systems, Inc., Wappingers Falls, NY (US)

(72) Inventors: Lloyd Wright, Hopewell Junction, NY (US); Leo Chin, Wappingers Falls, NY (US)

(73) Assignee: Solid State Cooling Systems, Wappingers Fall, NY (US)

( * ) Notice: Subject to any disclaimer, the term of this patent is extended or adjusted under 35 U.S.C. 154(b) by 611 days.

(21) Appl. No.: 14/245,704

(22) Filed: Apr. 4, 2014

(65) Prior Publication Data

US 2014/0305619 A1 Oct. 16, 2014

Related U.S. Application Data

(60) Provisional application No. 61/810,933, filed on Apr. 11, 2013.

(51) Int. Cl.

| | |
|---|---|
| ***F28F 3/02*** | (2006.01) |
| ***F28F 21/06*** | (2006.01) |
| ***F28F 3/12*** | (2006.01) |
| ***F28F 21/04*** | (2006.01) |

(52) U.S. Cl.
CPC ..... *F28F 3/02* (2013.01); *F28F 3/12* (2013.01); *F28F 21/04* (2013.01); *F28F 21/065* (2013.01)

(58) Field of Classification Search
CPC ..... F28F 3/12; F28F 3/02; F28F 21/04; F28F 21/065; H05K 7/20254
USPC ..... 165/185, 80.4; 361/702, 704
See application file for complete search history.

(56) References Cited

U.S. PATENT DOCUMENTS

| | | | | |
|---|---|---|---|---|
| 6,547,001 | B2 * | 4/2003 | McCullough | B21D 53/02 165/185 |
| 6,563,709 | B2 * | 5/2003 | Negishi | F28F 3/025 165/80.4 |
| 7,143,815 | B2 * | 12/2006 | Lee | H01L 23/473 165/104.28 |
| 8,189,335 | B2 * | 5/2012 | Janssen | H01L 23/3735 361/704 |
| 8,683,905 | B2 * | 4/2014 | Swinford | B21J 5/12 83/13 |
| 9,250,026 | B2 * | 2/2016 | Chen | F28F 3/02 |
| 2005/0128705 | A1 * | 6/2005 | Chu | H01L 23/473 361/699 |
| 2008/0029260 | A1 * | 2/2008 | Hu | F28F 3/027 165/182 |

FOREIGN PATENT DOCUMENTS

JP 2002329820 A * 11/2002

* cited by examiner

*Primary Examiner* — Tho V Duong
(74) *Attorney, Agent, or Firm* — Joseph P. Kincart; Rogers Towers PA

(57) ABSTRACT

The present invention provides a high efficiency thermal transfer plate for providing thermal transfer to and from a fluid. More specifically the present invention provides a thermal transfer plate including a skived fin plate for improved thermal transfer between a fluid within the thermal transfer plate and the thermal transfer plate.

13 Claims, 5 Drawing Sheets

HIGH EFFICIENCY THERMAL TRANSFER PLATE

CROSS REFERENCE TO RELATED APPLICATION

The present application claims priority to U.S. Provisional Patent No. 61/810,933, entitled "High Efficiency Cold Plate" filed Apr. 11, 2013 the contents of which are relied upon and incorporated herein by reference.

FIELD OF THE INVENTION

The present invention relates to a lightweight, high efficiency liquid containing thermal transfer plate and to methods and apparatus used to control a temperature of a liquid via a thermal transfer plate. More specifically, the present invention provides a thermal transfer plate with one or more skived fin thermal transfer surfaces contained within a low weight, easily formed body.

BACKGROUND

Efficient and low cost temperature control is an ongoing endeavor in multiple industries, including the semiconductor manufacture industry. Removal of large quantities of heat over a small area is critical to operation of many electronic devices such as computer microprocessors, isolated gate bipolar transistors (IGBTs), metal oxide field effect transistors (MOSFETs), thermoelectric devices and diode laser bars.

Since these devices generate a large amount of heat over a very small area, they require liquid cooling to prevent overheating. Traditionally, liquid thermal transfer plates were used in cooling applications. Traditional thermal transfer plates typically include a metal block with internal cooling channels through which a temperature controlled coolant. However, liquid thermal transfer plates tend to be expensive due to the use of meta. Metals such as aluminum and copper are preferred due to their relatively high rates of thermal transfer. Consequently, liquid thermal transfer plates tend to be heavy and expensive.

SUMMARY

Accordingly, the present invention provides includes a novel way to take advantage of metallic thermal transfer properties without requiring the entire thermal transfer plate be fabricated from metal. Improved methods and apparatus for temperature control are described and suggested herein. A liquid thermal transfer plate including one or more skived-fin thermal transfer plates including multiple skived fins are sealed within a plastic body. Sealing devices may include, for example, one or more o-rings or gaskets. The plastic body includes fluid channels to route fluid through the liquid thermal transfer plate in a pathway that places the liquid in contact with the skived fins.

An assembly of the parts may be fastened together via clamping screws or other mechanical fasteners. In some preferred embodiments, a plastic body is fabricated from a plastic with a thermal expansion coefficient closely matching a thermal expansion coefficient of the metal used in the skived-fin thermal transfer plates, such as Ultem®, to minimize stresses on the seals during operation.

Other embodiments include a skived fin thermal transfer plates of a same or similar material as the thermal transfer plate body. For example, a metallic thermal transfer plate may be matched with a metallic thermal transfer plate body.

Other examples may include a plastic with a high thermal transfer capability, such as for example a plastic including a thermal conductor. A thermal conductor may include, for example, a ceramic component, such as boron nitride or a compound. Today's smaller hotter and faster electronic assemblies may require a larger amount of heat dissipation in a faster response time. Plastics may also offer a low dielectric loss for applications where such concerns are present. A plastic thermal transfer plate body may offer a relatively good electrical insulation and high thermal conductivity. A thermal conductor may be crystalline or poly crystalline.

DESCRIPTION OF THE DRAWINGS

As presented herein, various embodiments of the present invention will be described, followed by some specific examples of various components that can be utilized to implement the embodiments. The following drawings facilitate the description of some embodiments.

DETAILED DESCRIPTION

Overview

The present invention provides an improved thermal transfer plate assembly for maintaining a temperature of a thermal load. According to the present invention, a skived fin thermal transfer plate is included in a thermal transfer plate assembly.

As used herein, "thermal transfer plate" or "Thermal Transfer Plate' shall mean a temperature plate including a fluid passageway for receiving a fluid and transferring thermal energy between the thermal transfer plate and the fluid.

Figure 1:
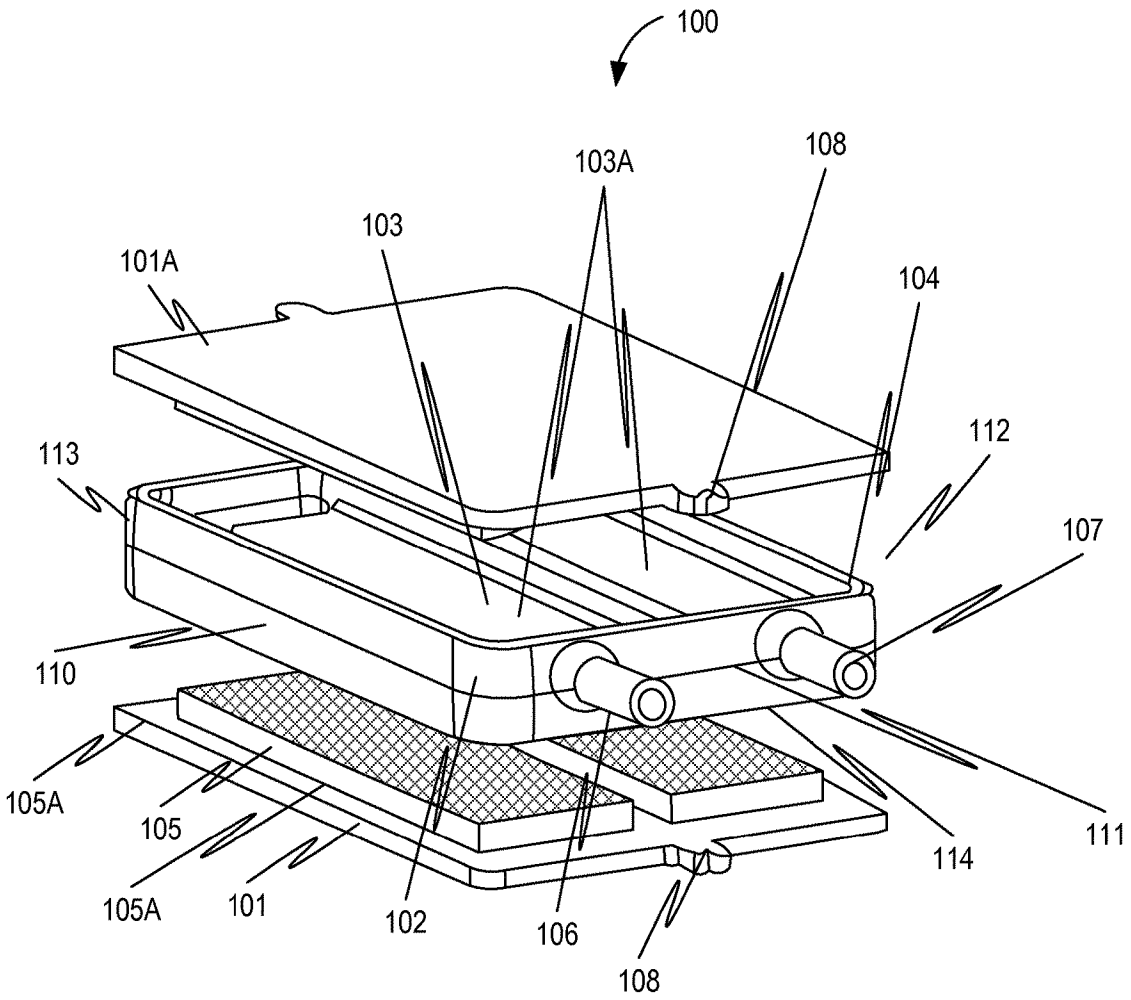
FIG. 1 illustrates an expanded view of components that may be included in a thermal transfer plate according to some embodiments of the present invention.

As used herein "skived fin" or Skived Fin" shall mean a heat sink with a base and multiple fins formed via a skiving process Referring now to FIG. 1, 100 a blow up diagram of parts that may be included in some embodiments of the present invention is illustrated. Essentially, one or more Skived Fin Plates 101-101A are housed within a Body 102. Fluid entered into the body via a fluid inlet 106 comes into contact with the one or more Skived Fins 105 included as part of the Skived Fin Plates 101-101A. A transfer of thermal energy takes place between the fluid and the one or more Skived Fin Plates 101-101A. The fluid then exits the Body 102 via a fluid outlet 107.

The Skived Fin Plate 101-101A is formed from a contiguous material and may be fashioned, for example via traditional skiving practices, or via a 3 dimensional printing process. Preferably the one or more Skived Plates 101-101A are formed from a material with a high thermal coefficient, such as copper or other metallic material or metallic compound. As new materials are developed it is within the scope of this invention to include a skived fin plate fashioned from a non-metallic material with favorable thermal conductivity characteristics. Generally a material with a high thermal coefficient is preferred.

According to the present invention, one or more skived fin thermal transfer plates 101-101A are housed in a casing of lighter weight material for optimal dissipation and transfer of the heat from the base to the Skived Fins 105 and an overall light weight and less expensive thermal transfer unit. Additionally, a skiving process used to form the fins 105 may increases the roughness of the heat-sink's fins. Unlike the underside of a heat-sink which typically benefits from a smooth surface for maximum surface area contact with the heat-source that it cools, the skived fins benefit from roughness due to an increased surface area of the fins 105. A non-smooth fin 105 surface area provides increased area for thermal energy transfer.

A Body 102 is used to fix the skived fin plate in a position to come into contact with a fluid entered into a fluid transport area 103. Preferred embodiments include a Body 102 fashioned from a plastic or other non-metallic material due to the light weight characteristics and inexpensive manufacturing. However, other materials may also be used to form the Body 102. Non-metallic materials that may be used to form the thermal transfer plate body may include for example, a plastic with a high thermal transfer capability, including, for example, a plastic with a thermal conductor. A thermal conductor may include, for example, a ceramic component, such as boron nitride or a compound such as a thermally conductive ceramic or metallic nanoparticle component.

A Body 102 will hold the one or more Skived Fin Plates 101-101A in contact with a fluid for which thermal energy control is desired. For example a fluid may be cooled or heated in order to maintain a desired temperature of the fluid.

The Body 102 may be fashioned from a thermoplastic via injection molding processes, or via a 3D printing process. The Body 102 includes a fluid transport area 103 defined by multiple Thermal transfer plate Body Sides 110-113. The fluid transport area 103 may additionally include one or more fluid Flow Channels 103*a*. Fluid Flow Channels 103*a* guide the path of fluid flowing within the Body 102.

The Skived Fin Plates 101-101A are housed within the Body 102 and fluid entered in to the Body 102 will come into contact with the Skived Fin Plate 101-101A. In some embodiments, fluid within the Body 102 will follow a route defined by fluid Flow Channels 103*a* and be guided into contact with the Skived Fins 105 on the Skived Fin Plates 101-101A. A thermal transfer will take place between the Skived Fin Plates 101-101A, including the Skived Fins 105, and fluid within the Body 102.

Fluid exits the Body 102 via a Fluid Outlet 107. The Fluid Inlet 106 and the Fluid Outlet 107 may generally include a tubing nozzle or other fixture for providing fluid communication between a thermal unit, such as a thermoelectric cooling unit and the Body 102.

As illustrated, the Thermal transfer plate Body 112 may include an upper sealed surface 113 and a lower sealed surface 114 and a respective skived fin thermal transfer plate 101-101A seals against each of the upper sealed surface 113 and the lower sealed surface 114. The seal 104 may include a gasket 104, such as an O-Ring gasket, a sealer, or other known sealing mechanism. The illustrated Thermal transfer plate Body 112 includes a lower thermal transfer plate 101 and an upper thermal transfer plate 101A. The seal 104 prevents liquid from inside the thermal transfer plate body 112 from leaking to an external environment.

Also as illustrated, a Fluid Inlet 106 and the Fluid Outlet 108 are both included on a same side 111 of the Body 102. However, other embodiments may include a straight through flow with a fluid inlet 106 in a generally linear path with a fluid outlet 107. Still other embodiments include a Fluid Inlet 106 on a different side 110-113 than the Fluid Outlet 107.

Skived Fin plates 101-101A may be fastened to the Body 102 via a Seal 104. The Seal 104 may include, for example, an O-Ring seal. Other types of Seal 104 may include a gasket, a cement or other sealant artifact.

In some embodiments, a Mechanical Fastening Point 108 may also be included in one or both of the Skived Fin Plate 101-101A and the Body 102. The Mechanical Fastening Point 108 will accommodate a fastening mechanism that secures the Skived Fin Plate 101-101A in a fixed position relative to the Body 102. The Seal 104 contains a liquid with the Body 102 and the Skived Fin Plate 101-101A. A Fastening Mechanism may include, by way of non-limiting example, a bolt, a screw, a rivet, a quick disconnect device, or other known mechanical fastening means.

Figure 2:
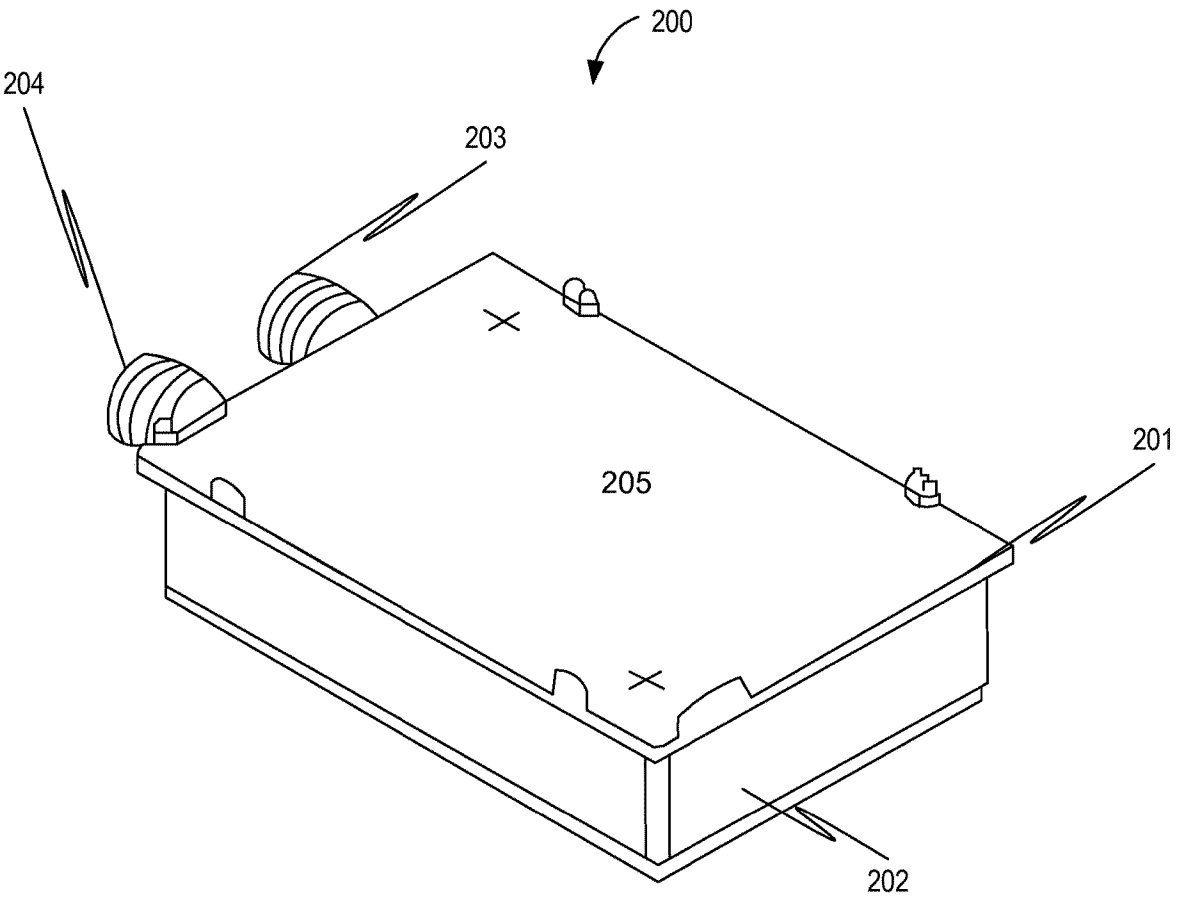
FIG. 2 illustrates an assembled version of some embodiments of a thermal transfer plate.

Referring now to FIG. 2, a perspective view is illustrated of a Thermal Transfer Plate Assembly 200 including a Skived Fin Plate 201 fastened to a skived fin plate Body 202. A fluid inlet 203 and a fluid outlet 204 may introduce and exit a fluid into contact with the skived fins (not shown) in the interior of the Body 202. The Thermal Transfer Plate Assembly 200 may include a heat transfer surface 205 with a smooth surface to increased surface area contact with an item placed on the heat transfer surface 205.

Figure 3:
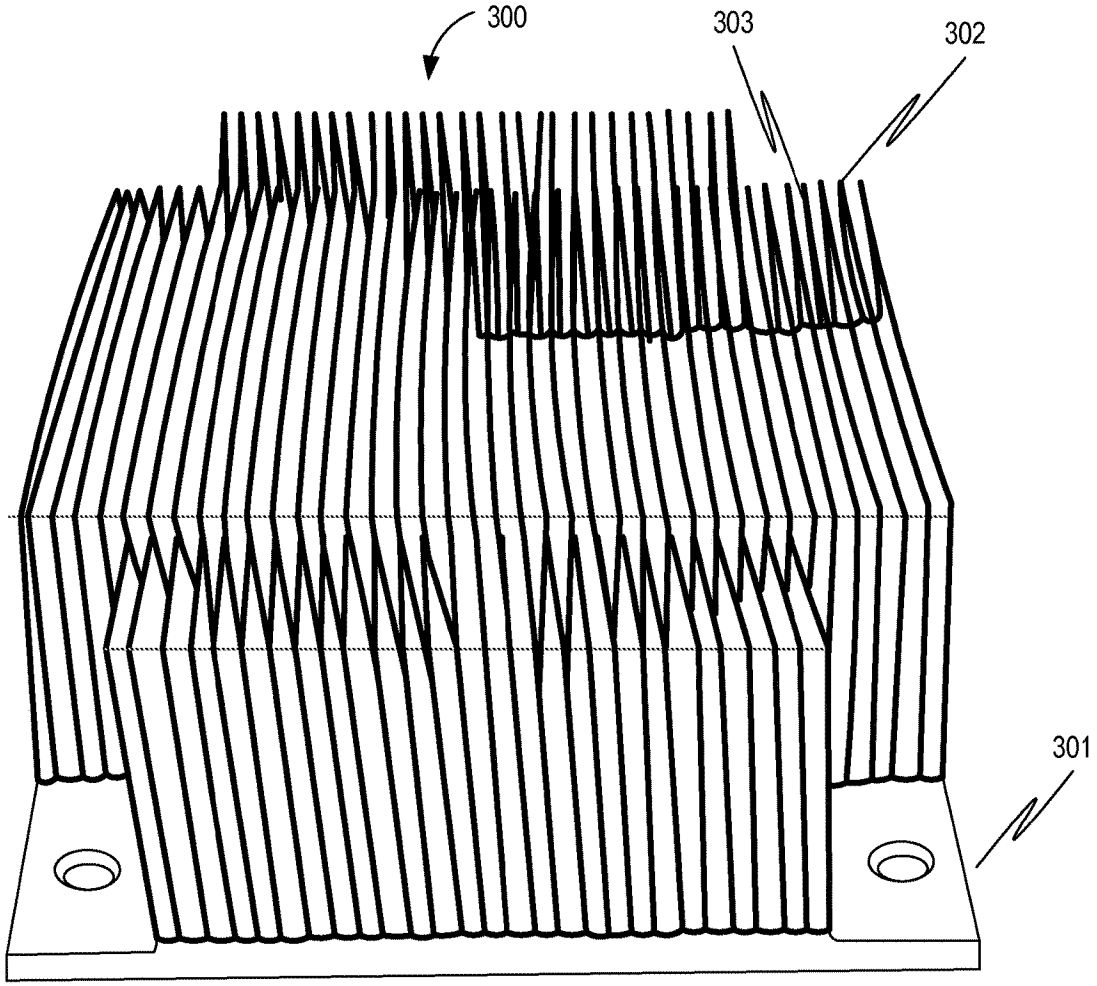
FIG. 3 illustrates some embodiments of a skived fin metallic thermal transfer plate.

Referring now to FIG. 3, a Skived Fin Plate 300 is illustrated with a plate 301 and multiple skived fins 302-303 attached to the skived fin plate 301. As discussed above, the multiple skived fins 302-303 are formed of a same contiguous material. In some embodiments a block of material, such as a metallic material, such as copper, is processed via a skiving process to form the skived fins. Other embodiments may include a plastic or other material with a desired thermal transfer property.

Figure 4:
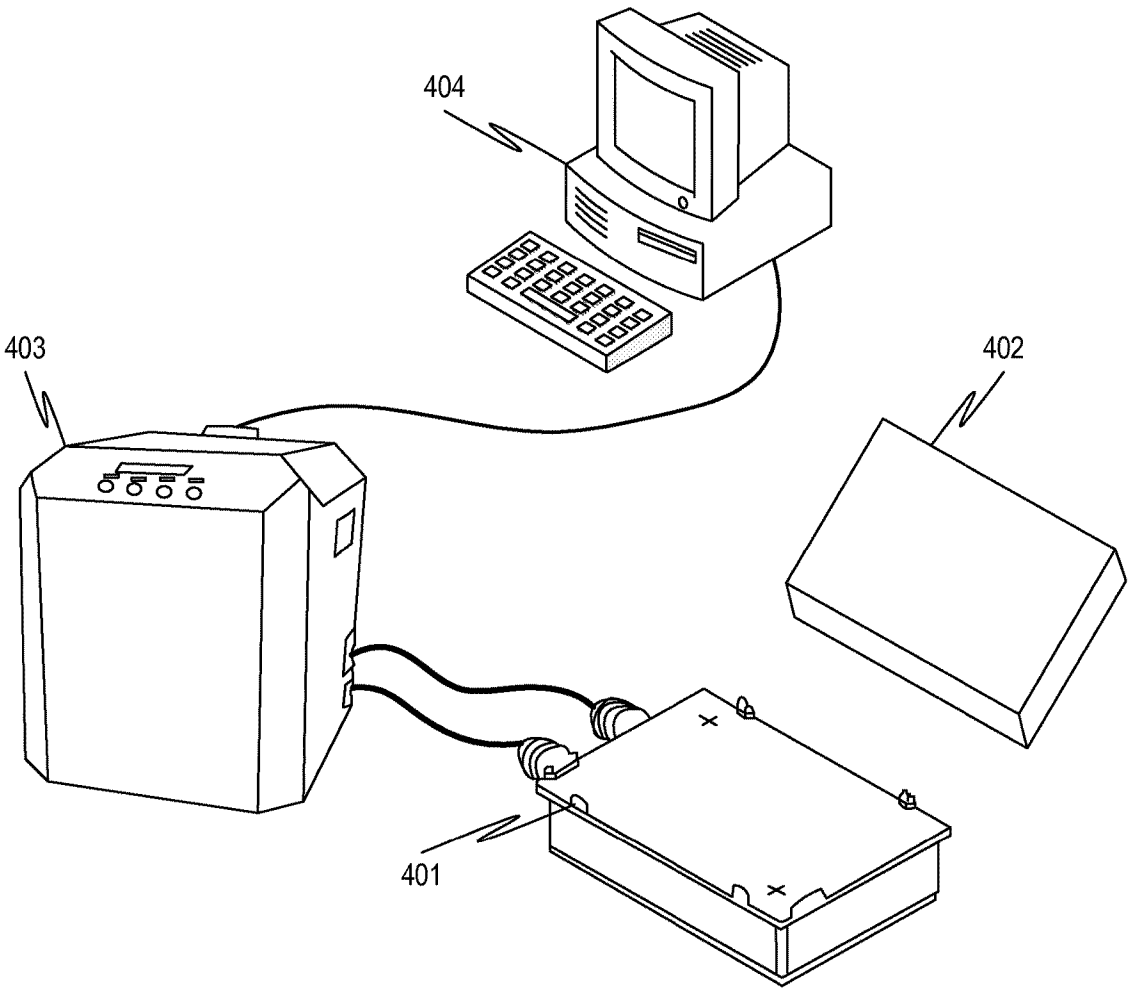
FIG. 4 illustrates some embodiments of a system for maintaining a temperature of a thermal load.

Referring now to FIG. 4, a system is illustrated to show a programmable controller 404 which is functional to control a temperature setting of a thermoelectric unit 403, such as, for example, a ThermoCube™ by Solid State Cooling Company, Inc. may be used in conjunction with a skived fin thermal transfer plate assembly 401. The thermoelectric unit 403 controls the temperature of a coolant may be circulated through the skived fin thermal transfer plate 401 with alignment legs (not shown in FIG. 4). The skived fin thermal transfer plate 401 may then be used to control a temperature of a thermal load 402. Typically, control of the temperature of the thermal load is desired within a tight tolerance. The present invention provides for such control with high efficiency.

Figure 5:
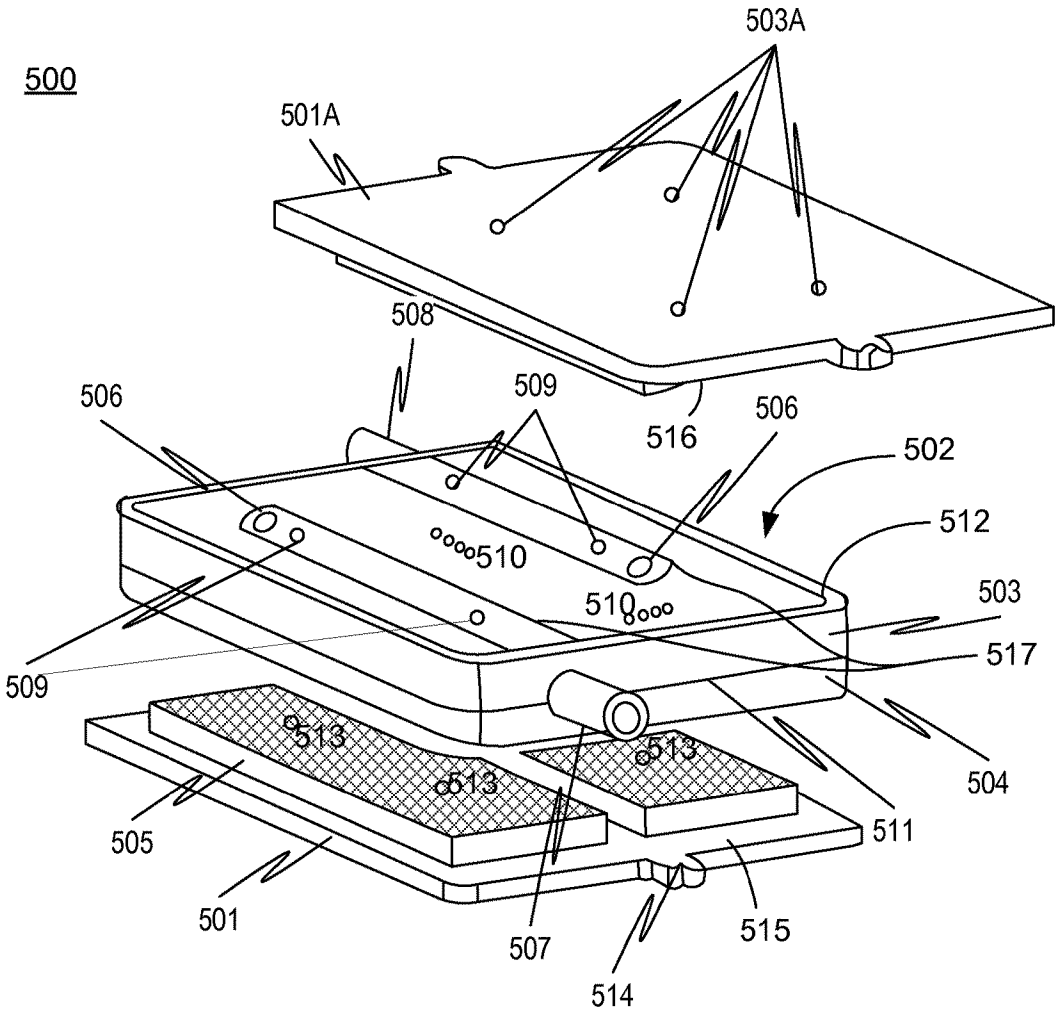
FIG. 5 illustrates some embodiments of an alternative design with an ingress and egress port in opposing directions.

Referring now to FIG. 5, a thermal transfer plate assembly 500 is illustrated according some additional embodiments of the present invention. Essentially, one or more Skived Fin Plates 501-501A are housed within a thermal transfer or cold plate Body 502. Fluid entered into the Body 502 via a fluid inlet 507 comes into contact with the one or more Skived Fins 505 included as part of the Skived Fin Plates 501-501A. A transfer of thermal energy takes place between the fluid and the one or more Skived Fin Plates 501-501A. The fluid then exits the Body 502 via a fluid outlet 508. As illustrated, the fluid inlet 507 and the fluid outlet 508 may include an ingress and an egress for fluid that are located in different sides of the body 502. For example, as illustrated, the inlet 507 and the outlet 508 are positioned on opposite sides 180 degrees opposed to each other. Other embodiments include an inlet 507 and an outlet 508 that are at an angle of 90 degrees or other angle.

A body 502 may also include an upper level 503 and a lower level 504. Fluid may enter a channel in contact with a thermal transfer plate 501A and be circulated through a via 505 or other pass through to a lower level 504. On the lower level the fluid may be placed in contact with one or more additional thermal transfer plates 501. Another via 506 may be used to circulate the fluid back to an upper level 503 and out a fluid egress, such as the outlet 508.

In another aspect, in order to improve sealing of an upper thermal transfer plate 501A to the body 502 and a lower thermal transfer plate 501, one or more fastener accesses 503A may be included in one or more thermal transfer plates 501-501A in a position interior to an edge 512 in the body 502. In some embodiments additional fastener access features may be included in the body. The access features may included a via or a threaded area for receiving a bolt of other fastener. Embodiments may also include an access hole 509 allowing access to an opposing thermal transfer plate 501 and fastener features 513 in the opposing thermal transfer plate 501. Fastener features 514 may also be included exterior to the body edge 512.

In another aspect alignment pins or other mechanical alignment features 510 may be used to assist in assembly and maintenance of a proper seal.

The Skived Fin Plate 501-501A may be formed from a contiguous material and may be fashioned, for example via traditional skiving practices, or via a three dimensional printing process. Preferably the one or more Skived Plates 501-501A are formed from a material with a high thermal coefficient, such as copper or other metallic material or metallic compound. As new materials are developed it is within the scope of this invention to include a skived fin plate fashioned from a non-metallic material with favorable thermal conductivity characteristics. Generally a material with a high thermal coefficient is preferred.

According to the present invention, one or more skived fin thermal transfer plates 501-501A are housed in a casing of lighter weight material for optimal dissipation and transfer of the heat from the base to the Skived Fins 505 and an overall light weight and less expensive thermal transfer unit. Additionally, a skiving process used to form the fins 505 may increases the roughness of the heat-sink's fins. Unlike the underside of a heat-sink which typically benefits from a smooth surface for maximum surface area contact with the heat-source that it cools, the skived fins benefit from roughness due to an increased surface area of the fins 505. A non-smooth fin 505 surface area provides increased area for thermal energy transfer.

A Body 502 is used to fix the skived fin plate in a position to come into contact with a fluid entered into a fluid transport area 517. Preferred embodiments include a Body 502 fashioned from a plastic or other non-metallic material due to the light weight characteristics and inexpensive manufacturing. However, other materials may also be used to form the Body 502. Non-metallic materials that may be used to form the thermal transfer plate body may include for example, a plastic with a high thermal transfer capability, including, for example, a plastic with a thermal conductor. A thermal conductor may include, for example, a ceramic component, such as boron nitride or a compound such as a thermally conductive ceramic or metallic nanoparticle component.

A Body 502 will hold the one or more Skived Fin Plates 501-501A in contact with a fluid for which thermal energy control is desired. For example a fluid may be cooled or heated in order to maintain a desired temperature of the fluid.

The Body 502 may be fashioned from a thermoplastic via injection molding processes, or via a 3D printing process. The Body 502 includes a fluid transport area defined by multiple Thermal transfer plate Body 502 sides. The fluid transport area may additionally include one or more fluid Flow Channels 517. Fluid Flow Channels 517 guide the path of fluid flowing within the Body 502.

The Skived Fin Plates 501-501A are housed within the Body 502 and fluid entered in to the Body 502 will come into contact with the Skived Fin Plate 501-501A. In some embodiments, fluid within the Body 502 will follow a route defined by fluid Flow Channels 517 and be guided into contact with the Skived Fins 505 on the Skived Fin Plates 501-501A. A thermal transfer will take place between the Skived Fin Plates 501-501A, including the Skived Fins 505, and fluid within the Body 502.

Fluid exits the Body 502 via a Fluid Outlet 508. The Fluid Inlet 507 and the Fluid Outlet 508 may generally include a tubing nozzle or other fixture for providing fluid communication between a thermal unit, such as a thermoelectric cooling unit and the Body 502.

As illustrated, the Thermal transfer plate Body 502 may include an upper sealed surface 516 and a lower sealed surface 515 and a respective skived fin thermal transfer plate 501-501A seals against each of the upper sealed surface 516 and the lower sealed surface 515. The seal 512 may include a gasket 512, such as an O-Ring gasket, a sealer, or other known sealing mechanism. The illustrated Thermal transfer plate Body 502 includes a lower thermal transfer plate 501 and an upper thermal transfer plate 501A. The seal 512 prevents liquid from inside the thermal transfer plate Body 502 from leaking to an external environment.

Also as illustrated, a Fluid Inlet 507 and the Fluid Outlet 508 are both included on a same side 511 of the Body 502. However, other embodiments may include a straight through flow with a fluid inlet 507 in a generally linear path with a Fluid Outlet 508. Still other embodiments include a Fluid Inlet 507 on a different side 511 of the Body 502 than the Fluid Outlet 508.

Skived Fin Plates 501-501A may be fastened to the Body 502 via a Seal 512. The Seal 512 may include, for example, an O-Ring seal. Other types of Seal 512 may include a gasket, a cement or other sealant artifact.

In some embodiments, a Mechanical Fastening Point 508 may also be included in one or both of the Skived Fin Plate 501-501A and the Body 502. The Mechanical Fastening Point 503A will accommodate a fastening mechanism that secures the Skived Fin Plate 501-501A in a fixed position relative to the Body 502. The Seal 512 contains a liquid with the Body 502 and the Skived Fin Plate 501-501A. A Fastening Mechanism may include, by way of non-limiting example, a bolt, a screw, a rivet, a quick disconnect device, or other known mechanical fastening means.

CONCLUSION

A number of embodiments of the present invention have been described. Nevertheless, it will be understood that various modifications may be made without departing from the spirit and scope of the invention. For example, various methods or equipment may be used to implement the process steps described herein or to create a device according to the inventive concepts provided above and further described in the claims. In addition, various data communication mechanisms and thermal transfer mechanisms may be utilized for various aspects of the present invention. Accordingly, other embodiments are within the scope of the following claims.

What is claimed is:

1. A skived fin thermal transfer plate for use with a thermal exchange unit, said skived fin thermal transfer plate comprising:

a thermal transfer plate body comprising a thermoplastic fluid transport area and additionally comprising an upper skived fin thermal transfer plate and a lower skived fin thermal transfer plate, and the thermoplastic fluid transport area fluid transport area bounded by multiple thermal transfer plate body sides and an upper sealing surface and a lower sealing surface;

the upper skived fin thermal transfer plate bounding the upper sealing surface to form an upper fluidic seal and comprising an upper single contiguous piece of copper comprising an upper base and multiple upper skived fins with increased roughness on a surface of the respective multiple upper skived fins, wherein the upper skived fins are positioned so that at least a portion of the upper skived fins are within the fluid transport area, a lower skived fin plate bounding the lower sealing surface to form a lower fluidic seal and comprising a lower single contiguous piece of copper comprising a lower base including a smooth heat transfer surface and multiple lower skived fins with increased roughness on a surface of the respective multiple lower skived fins, wherein the lower skived fins are positioned so that at least a portion of the lower skived fins are within the fluid transport area; and a fluid inlet in fluid communication with the fluid transport area and a fluid outlet also in fluid communication with the fluid transport area.

2. The skived fin thermal transfer plate of claim 1 wherein the thermal transfer plate body additionally comprises a tubing nozzle in the fluid inlet and a tubing nozzle in the fluid outlet for transporting a fluid into and out of the thermal transfer plate body, and said fluid inlet and said fluid outlet are located on a same side of the thermal transfer plate body.

3. The skived fin thermal transfer plate of claim 2, additionally comprising a seal for sealing the skived fin plate to the thermal transfer plate body.

4. The skived fin thermal transfer plate of claim 3, wherein seal is capable of containing a fluid within the fluid transport area other than the fluid inlet and the fluid outlet.

5. The skived fin thermal transfer plate of claim 4 where the seal comprises a gasket material.

6. The skived fin thermal transfer plate of claim 4 wherein the seal comprises an O-Ring.

7. The skived fin thermal transfer plate of claim 4 additionally comprising fluid flow channels for guiding a fluid through the thermal transfer plate body.

8. The skived fin thermal transfer plate of claim 4 wherein thermal transfer occurs between a fluid in the fluid transport area and the skived fins included in the skived fin plate.

9. The skived fin thermal transfer plate of claim 7 where the fluid flow channels form a serpentine pattern.

10. The skived fin thermal transfer plate of claim 1 additionally comprising one or more fastening mechanisms to fixedly fastening the one or more skived fin thermal transfer plates to the thermal transfer plates body.

11. The skived fin thermal transfer plate of claim 1 wherein the thermoplastic fluid transport area comprises a material of lighter weight than the copper comprising the lower skived fin plate and the material of lighter weight comprises a thermal expansion coefficient closely matching the thermal coefficient of copper.

12. The skived fin thermal transfer plate of claim 11 additionally comprising two or more fasteners positioned interior to the multiple sides of the body.

13. The skived fin thermal transfer plate of claim 12 wherein the fasteners comprise a threaded bolt.

* * * * *